US006293253B1

(12) United States Patent
Arnold et al.

(10) Patent No.: US 6,293,253 B1
(45) Date of Patent: Sep. 25, 2001

(54) CONTROL FOR A FLUID PRESSURE SUPPLY SYSTEM, PARTICULARLY FOR HIGH PRESSURE IN A FUEL INJECTION SYSTEM

(75) Inventors: Bernhard Arnold, Roden-Ansbach; Egon Eisenbacher, Karlstadr/Main; Franz Pawellek, Hafenlohr, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 08/825,189

(22) Filed: Mar. 27, 1997

(30) Foreign Application Priority Data

Mar. 28, 1996 (DE) ..... 196 12 412

(51) Int. Cl.[7] ..... F02M 41/00
(52) U.S. Cl. ..... 123/458; 123/446
(58) Field of Search ..... 123/456, 446, 123/506, 458, 514

(56) References Cited

U.S. PATENT DOCUMENTS

| | | | | |
|---|---|---|---|---|
| 4,719,889 | * | 1/1988 | Amann | 123/456 |
| 5,447,138 | * | 9/1995 | Barnes | 123/446 |
| 5,458,103 | * | 10/1995 | Lauvin | 123/446 |
| 5,598,817 | * | 2/1997 | Igarashi | 123/456 |
| 5,626,121 | * | 5/1997 | Kushida | 123/456 |
| 5,642,716 | * | 7/1997 | Ricco | 123/514 |

FOREIGN PATENT DOCUMENTS

| | | |
|---|---|---|
| 916 136 | 8/1954 | (DE) . |
| 44 01 083 | 7/1955 | (DE) . |
| 933 838 | 10/1955 | (DE) . |
| 2 350 766 | 7/1974 | (DE) . |
| 34 11 539 | 10/1985 | (DE) . |
| 35 09 856 | 10/1985 | (DE) . |
| 34 38 015 | 4/1986 | (DE) . |
| 065 304 | 11/1982 | (EP) . |
| 299 337 | 1/1989 | (EP) . |
| 629 777 | 12/1994 | (EP) . |

* cited by examiner

*Primary Examiner*—Carl S. Miller
(74) *Attorney, Agent, or Firm*—Herbert L. Lerner; Laurence A. Greenberg; Werner H. Stemer

(57) ABSTRACT

A control for a pressure fluid supply system is described, in particular for the high pressure in a fuel injection system, for example for an internal combustion Diesel engine, by means of which the pressure in a common high-pressure line supplied by a high-pressure pump, i.e. in the common rail, to which individual consumers are connected, is controlled in accordance with the instantaneous pressure fluid requirements. For adapting the pressure in the common high-pressure line to the pressure fluid requirements of the consumers, i.e. the injection nozzles, a device for limiting the amounts of fluids conveyed is associated with the high-pressure pump, which has at least on adjusting element which can be changed by means of an adjusting signal representing the instantaneous pressure fluid supply situation in the common rail. To avoid an elaborate pressure sensor device in the common rail and for the simultaneous improvement of the reaction behavior of the control, in particular when reducing the high pressure in the common rail, the adjusting signal is derived from the amount of fluid throughput in the delivery line of a pressure control valve connected to the common rail. The pre-conveying pressure or the pre-conveying amount available to the high-pressure pump is affected by means of this adjusting signal in the sense of a regulation of the pressure in the common rail.

28 Claims, 4 Drawing Sheets

CONTROL FOR A FLUID PRESSURE SUPPLY SYSTEM, PARTICULARLY FOR HIGH PRESSURE IN A FUEL INJECTION SYSTEM

BACKGROUND OF THE INVENTION

The invention relates to a control for a pressure fluid supply system, in particular for the high pressure in a fuel injection system, for example for an internal combustion Diesel engine, in accordance with the preamble of claim 1.

PRIOR ART

A control of this type has become known, for example, from the document EP 0 299 337 A2. A suction throttle located in the suction line of the high-pressure pump is employed here as the device limiting the amount of fluid conveyed, which is set in accordance with the pressure fluid requirement of the consumers in such a way that the high-pressure pump only conveys the actually required pressure fluid amounts into the common high-pressure line, i.e. the common rail. In this known case this is referred to as suction pressure control, which operates as follows:

A pressure sensor is provided in the common high-pressure line, i.e. the common rail, whose pressure signal is provided to a control unit which, as a rule, operates electronically, and is compared there with a set value determined by the operating conditions of the internal combustion engine. An adjustment signal is issued in accordance with the control difference, which adjusts the suction throttle until the set pressure value has been attained in the common rail.

Comparatively elaborate electronic sensor devices and corresponding electronic devices are therefore connected with the known suction throttle control which—as has been found—still has an inadequate response behavior and too slow a control speed for certain areas of application. In the known case this lack of dynamics appears in particular when it is necessary to relieve the pressure in the common rail extremely rapidly. Although the suction throttle valve can be rapidly closed in this case, the high-pressure area, i. e. the common rail, can only be relieved as the result of amounts of leakage or remaining injection amounts.

The object of the invention is therefore based on providing a control for a pressure fluid supply system, in particular for the high pressure in a fuel injection system, for example for an internal combustion Diesel engine, which is distinguished by improved control dynamics, in particular when reducing the pressure in the common rail, while avoiding elaborate electronic sensor devices.

SUMMARY OF THE INVENTION

In accordance with the invention, the pressure in the common high-pressure line, i.e. the common rail, is protected via a high-pressure pressure control valve, preferably in the embodiment of an electrically triggered pressure control valve. The adjusting signal for charging the adjusting element of the device limiting the amount of fluid conveyed is derived from a physical value, which changes in accordance with the amount of fluid throughput in the delivery line of the preferably adjustable pressure control valve. The same as the adjusting signal of the pressure sensor device of the prior art, this adjustment signal operates in the sense of a reduction of the control deviation, but with the particular advantage that the control system can be kept considerably shorter. The control the pressure in the common rail with only the adjustable pressure control valve is therefore achieved, which is preferably embodied as a proportional pressure valve, and to limit the amount of excess pressure fluid or fuel fed by the high-pressure pump into the common rail by means of the derived control signal in the delivery line in such a way, that the energy losses are kept as low as possible.

The particular advantage of the control in this case rests in the higher dynamics, because the downward control of the pump occurs simultaneously with the triggering of the pressure control valve. In other words, the pressure release in the common rail is no longer performed as a result of leakage amounts or remaining injection amounts flowing off, but actively by the adjustable pressure control valve. In the process, increased safety results in case of problems which may occur in the common rail, for example upon the appearance of an emergency in the system, for example binding of an injection nozzle needle or like occurrence. If in such a case the pressure control valve is triggered, it is possible by means of the amount of fluid flowing off, to generate a corresponding adjustment signal, preferably with suitable amplification, so that the high-pressure pump is abruptly reduced to a minimal conveying volume. Therefore dangerous situations can also very quickly be defused by means of the control in accordance with the invention. On the other hand it is possible to achieve pressure build-ups which are easily comparable to systems with suction pressure control.

It has been shown that a very good response behavior of the control can be realized with an adjustable pressure control valve, in particular in the embodiment as an electrically triggered pressure control valve, because a direct force comparison between the pressure force and magnetic force is performed in such a pressure control valve. The behavior of the control can be optimized by means of a suitable adaptation of the adjusting signal of the pressure control valve to the opening characteristics and/or the generation of the adjusting signal, for example in order to keep the excess amount of fluid conveyed by the high-pressure pump at a negligibly small value.

The pressure control valve is advantageously embodied as a proportional control valve. As a substitute, however, it is also possible with the aid of an appropriate electronic device to correct a non-proportional characteristic curve of the pressure to become a control current, wherein it is then also possible to employ a pressure control valve with a non-linear characteristic curve.

The control principle in accordance with the invention can be realized by means of the most diverse adjusting signals. However, a particularly simple way of control results if the adjusting signal is derived from a dynamic pressure upstream of a dynamic throttle in the delivery line. It is possible by means of this further development to maintain the dynamics of control at a very high level, because by means of the dynamic pressure it is possible to send the adjusting signal with good and adaptable amplification to the device for limiting the amounts of fluid conveyed.

Further than that, the control is also suitable for the most diverse embodiments of the device for limiting the amounts of fluid conveyed. If the suction throttle device has a number of suction valves corresponding to the number of the displacement devices of the high-pressure pump, the amounts conveyed by the pump can be easily adapted to the needs of the injection system. In this case it is basically possible to throttle the individual suction valves simultaneously. Additional possibilities of fine matching to the conveyed amounts actually needed by the common rail result from the sequential triggering of the suction valves.

A further variant is the design of the device for limiting the amounts of fluid conveyed. Here the adjusting signal, for example the dynamic pressure upstream of a dynamic throttle in the delivery line, can be used to shut off one displacement device or several displacement devices individually. This can be accomplished through a single control valve, which directly blocks the inflow to the respective displacement device, or by an actuating element, which acts directly via a plunger on a closing body of the suction valves of the respective displacement device and keeps this closing body permanently open, so that this displacement device does not perform any displacement work anymore. With this variant it is also possible for the individual adjusting elements to respond sequentially to the adjusting signal wherein a greater latitude for the exact adjustment of the displaced volume results, particularly in connection with pumps with a multitude of displacement pistons.

The device for limiting the amount of fluid conveyed can also be provided in that a pre-conveying pump, which feeds the high-pressure pump, is correspondingly adjusted.

The further development of the control has the particular advantage that with a simple design the adjustable delivery plate can additionally take on the function of a safety valve, by means of which a rapid pressure relief in the common rail is assured in case the amount of fluid throughput in the delivery line should become too large. This variant is of particular advantage if the adjusting signal is derived from the dynamic pressure upstream of a dynamic throttle in the delivery line. In this case it is only necessary to provide an additional control edge on the control piston of the delivery plate, by means of which the delivery line of the pressure control valve can be relieved in a short time into a low pressure range while being freed to a great extent from throttling.

If a safety valve is disposed in the bypass to a pre-conveying pump, with which a plate is connected parallel, an advantageous influence on the control of the pre-conveying pump can be exerted as a function of the rpm of the internal combustion engine. This opens the possibility of a finer pressure control, in particular in connection with the device for limiting the amount of fluid conveyed. A noticeable improvement of the control accuracy results in particular the control in combination with an delivery plate controlled by dynamic pressure.

The adjusting signal reflecting the instantaneous pressure supply situation in the common high-pressure line (common rail) can directly correspond to the dynamic pressure; however, in the same way it is possible to obtain this adjusting signal by means of a low-pressure sensor in the delivery line. The sensor signal then is appropriately evaluated in order to serve corresponding displacement elements on the suction side of the pump or corresponding individual control elements or ad us ting elements at the displacement devices of the pump. Such a low-pressure sensor is cheaper and less sensitive than a pressure sensor for the common rail and can be used equally effectively for the control of the system with high dynamics.

If the adjusting signal is derived from the temperature in the delivery line, the adjusting signal can be obtained by means of a thermostat made of an expanding material, i.e. by means of a thermal sensor with a wax element. The lift of the input member of the thermal sensor can be used as the adjusting value for affecting the suction throttle valve or other adjusting elements for changing the conveyed fluid volume. No dynamic throttle is required in this case.

Finally, the adjusting signal can be derived from a movement value, for example from the stroke of the pressure control valve.

BRIEF DESCRIPTION OF THE DRAWINGS

Several exemplary embodiments of the invention will be explained in detail below, making reference to schematic drawings. Shown therein are.

DETAILED DESCRIPTION OF PREFERRED EMBODIMENTS OF THE INVENTION

Figure 1:
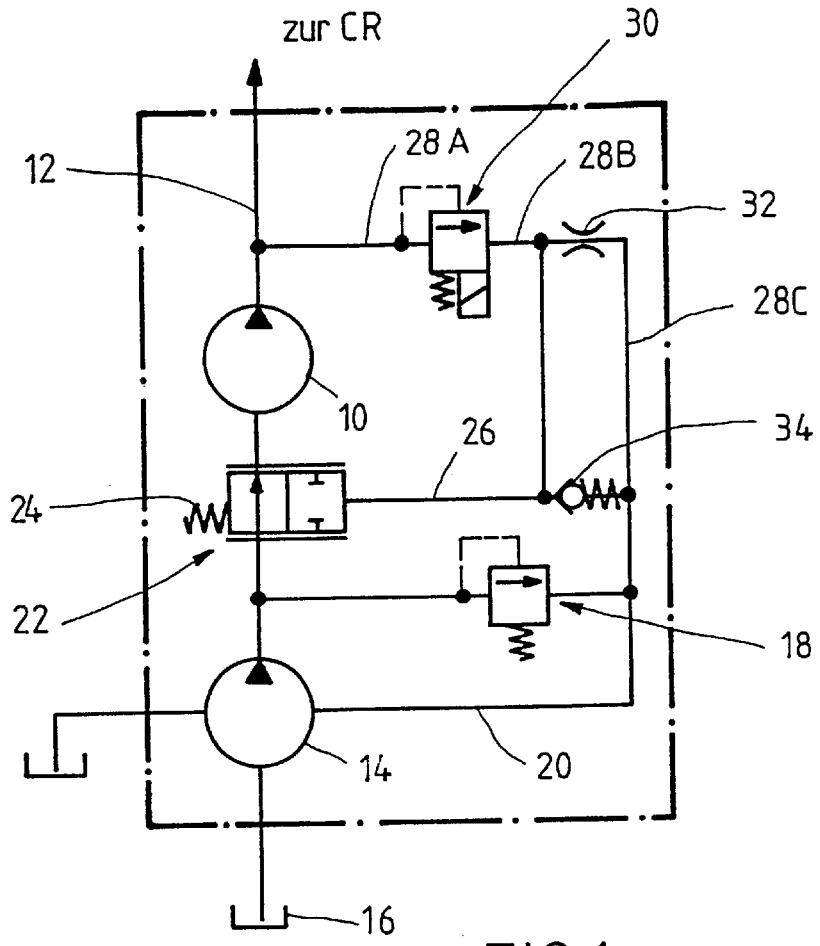
FIG. 1, a hydraulic circuit for controlling a pressure fluid supply system, in particular for the high pressure in a fuel injection system of, for example, an internal combustion Diesel engine, by means of which the pressure in a common rail supplied by a high-pressure pump can be adjusted in accordance with the instantaneous pressure fluid requirements, with a first embodiment of a device limiting the amount of pressure fluid and a first embodiment for the derivation of an adjusting signal reflecting the instantaneous pressure fluid supply situation in the common rail.

A high-pressure pump in FIG. 1 is identified by the reference numeral 10, which for example is designed as a radial piston pump and is able to build up extremely high pressures in a high-pressure line 12 leading to the so-called "common rail" of a fuel injection system. The high-pressure pump 10 is designed similar to a radial jet pump, i.e. it is able to provide a changing conveying output with an unchanged stroke and as a function of the pressure fluid supply. The high-pressure pump is supplied by a pre-conveying pump 14, i.e. a low-pressure pump, which aspirates pressure fluid, i.e. fuel, from a tank 16. The pre-conveying pump 14 is protected by means of a pressure control valve (5 bar valve) 18. The corresponding return line leading via the pre-conveying pump 14 to the tank is identified by 20. In order to control the pressure in the common rail, to which individual consumers, not shown in detail, in particular injection nozzles of the internal combustion engine, are connected, in accordance with the instantaneous pressure fluid requirements, i.e. as a function of the operating parameters of the system, i.e. the internal combustion Diesel engine, a device for limiting the amount of fluid conveyed is associated with the high-pressure pump 10, which is constituted by a suction throttle valve 22 in the embodiment of FIG. 1. For the constant adjustment of suction throttle cross section, the body of the suction throttle valve is acted upon against the force of a spring 24 by an adjusting signal in a line 26 in such a way that the adjusting signal reflects the instantaneous pressure fluid supply situation in the common high-pressure line 12 or common rail CR. In other words, the adjusting signal in the line 26 acts on the suction throttle valve 22 in such a way that the amount conveyed by the high-pressure pump 10 is kept just large enough so that the desired pressure in the common rail, corresponding to the instantaneous prevailing operating parameters of the internal combustion engine, is produced. The particularity of the circuit in accordance with FIG. 1 resides in the special way of obtaining the adjusting signal in the line 26:

A delivery line 28 is connected to the common high-pressure line 12, which has three sections, namely sections 28A, 28B and 28C. A pressure control valve 30, which preferably is adjustable, is disposed in this delivery line and is preferably designed as an electrically triggered pressure control valve. The electrical triggering takes place as a function of the operating parameters of the system to be supplied, i.e. in the present case the internal combustion engine. The pressure control valve is located between the line sections 28A and 28B. A dynamic throttle 32, by means of which the adjusting signal in the line 26 can be generated, is located between the sections 28B and 28C. The line 26 is connected upstream of the dynamic throttle 32 to the delivery line 28. This has the result that the adjusting signal, i.e. the pressure in the signal line 26, is derived from a physical value which changes in accordance with the amount of fluid throughput in the delivery line 28 of the pressure control valve 30. The adjusting signal in the signal line 26 acts via the suction throttle valve 22 of the high-pressure pump 10 in such a way that, as a function of the prevailing dynamic pressure upstream of the throttle 32, the suction throttle valve opens the cross section on the suction side of the pump in a balance of force with a spring to a greater or lesser degree, because of which it is possible to control the pressure in the line 12, and therefore in the common rail, solely by means of the pressure control valve 30, which preferably is designed as a proportional pressure control valve, by means of the occurring excess amount from the high-pressure pump in comparison with the amount needed for injection, in such a way that only a minimal excess amount is conveyed at all times. This excess amount is ejected via the high-pressure control valve, i.e. the pressure control valve 30, and generates upstream of the dynamic throttle 32 a set dynamic pressure, which supplies the adjusting signal for the device limiting the amount of fluid conveyed.

Very high dynamics result with this control system. which has special advantages when reducing the pressure in the common rail. Conventional suction throttle pumps which in addition operate with an elaborate pressure sensing system in the common rail, have the problem that the high-pressure area is not relieved sufficiently fast in spite of the rapid slowing of the pump, and that the pressure reduction only occurs as the result of amounts of leakage or remaining injection amounts. In contrast to this the high-pressure control valve can reduce the pressure in the common rail very rapidly when required. In the process a large excess amount is routed through the pressure control valve and therefore a high dynamic pressure generated at the dynamic throttle, which leads to very rapid closing of the suction throttle valve upstream of the pump and therefore reduces the amount conveyed by the pump abruptly to zero. In the process the pressure control valve, which is preferably adjustable and which is designed as a proportional pressure control valve in accordance with an advantageous embodiment, can simultaneously be used to abruptly reduce the pressure in the common rail when needed, i.e. if problematic situations occur in the injection system. In this case it is advantageous to bridge the dynamic throttle 32 with a safety valve 34, which for example is embodied as a prestressed nonreturn valve. The safety valve is therefore inserted between the signal line 26 and the section 28C of the delivery line 28.

The above described control is therefore able to handle the energy side optimally without an elaborate pressure sensing device in such a way that more or less only the amount is conveyed into the high-pressure section which is effectively needed as the needed injection amount. This also results in that an unnecessarily large excess amount does not introduce inadmissably large amounts of heat into the fuel tank, so that elaborate cooling devices can be omitted.

Figure 2:
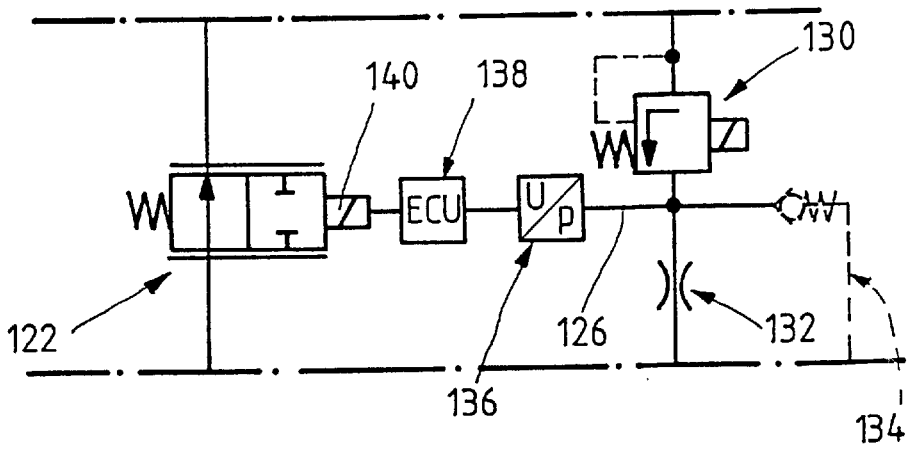
FIG. 2, a schematic circuit diagram for explaining a further variant of adjusting signal processing for adjusting the device for limiting the amounts of fluid conveyed.

In the exemplary embodiment in accordance with FIG. 1, a suction throttle valve 22 is provided as the device limiting the amount of fluid conveyed, whose adjusting element is directly acted on by the line pressure in the signal line 26. However, in the same way it is also possible to act on the valve body of the suction throttle valve with a converted signal. This variant is indicated in FIG. 2. Here., comparable elements of the control circuit are provided with similar reference numerals for those components which correspond to the components in FIG. 1, wherein they are only preceded by a "1".

A signal pressure line 126, into which a low-pressure sensor 136 has been integrated, whose output signal is processed in an electrical circuit 138 in such a way that the output signal can be supplied directly to the adjusting element 140 of the suction throttle valve 122, branches off the output side 128B of the pressure control valve 130. The control characteristic of the system can be affected by simple means via the circuit 138. Even this embodiment can be produced more efficiently than the control in accordance with the prior art, because the low pressure sensor is cheaper than a high-pressure sensor device.

A safety valve arrangement 134 is identified by dashed lines in FIG. 2, which is designed similar to the safety valve in accordance with FIG. 1.

Figure 3:
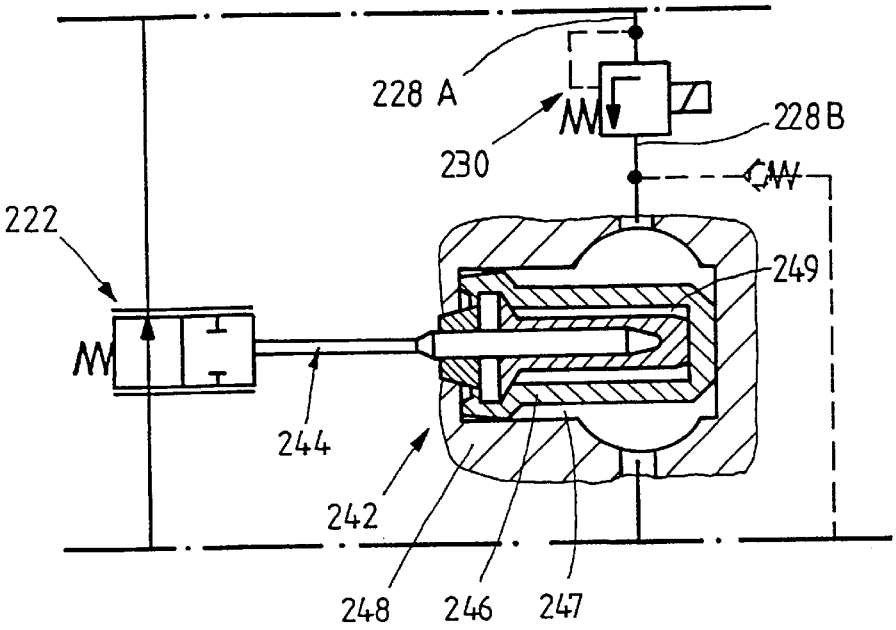
FIG. 3, is a circuit diagram in a representation corresponding to FIG. 2 for explaining a further variant for obtaining an adjusting signal representing the instantaneous pressure fluid supply situation in the common rail.

The embodiment in accordance with FIG. 3 differs from the previously described embodiments in that the adjusting signal acting on the limiting device for the amount of fluid conveyed is obtained in a different way. As before, the adjusting signal changes in accordance with the amount of fluid throughput in the delivery line 228, in which an adjustable pressure control valve 230 has again been disposed. However, in this embodiment the suction throttle valve 222 is triggered by means of a thermal sensor 242. As a function of the amount sprayed out by the pressure control valve, the adjusting element 244 of the thermal sensor 242 is also moved here in the sense that the suction throttle valve changes the amount supplied to the high-pressure pump in such a way that only the amount of fluid required for maintaining the set pressure in the common rail is made available and conveyed.

The thermal sensor 242 is an element made of an expanding material, known per se, around which the outflowing fuel in the line 228B flows. To this end, for forming an annular chamber 247 the metal box 246 is received in a housing 248, out of which the work piston (adjusting element) 244 projects. The element made of an expanding material is identified by 249 and is subject to temperature fluctuations as a function of the amount of fuel sprayed off, because of which the adjusting element 244 is extended to a greater or lesser extent out of the metal box 246.

Figure 4:
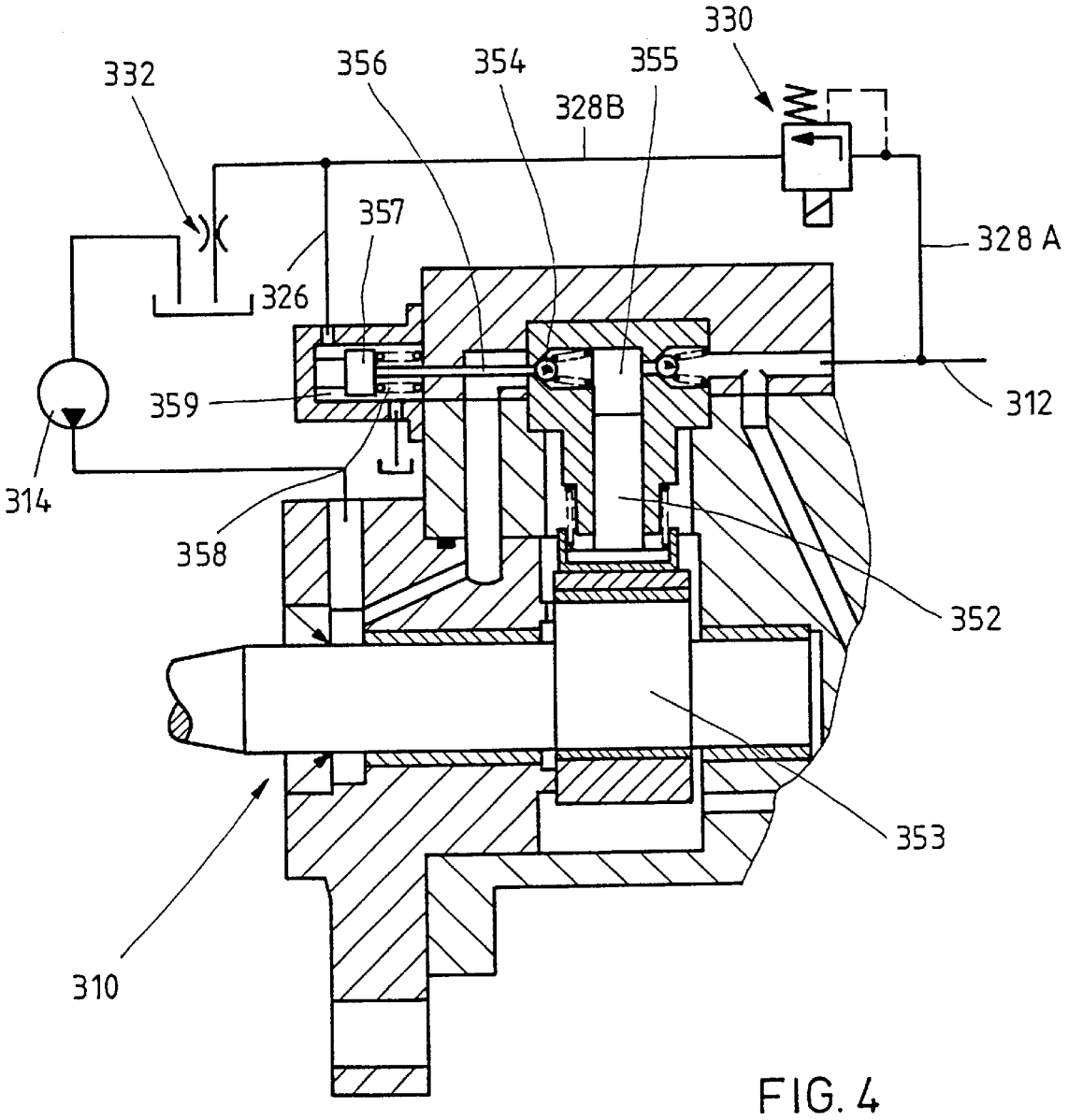
FIG. 4, a representation by means of a schematic section through the high-pressure pump of a further embodiment of adjusting signal processing for controlling the pressure in the common rail.

The above described exemplary embodiments have in common that the adjusting signal acts on a central device for limiting the amount of fluid conveyed in the form of a suction throttle in such a way, that the supply volume for the high-pressure pump is changed. In contrast thereto, in the embodiment in accordance with FIG. 4 the adjusting signal is employed for changing the compression output of the high-pressure pump. In connection with the embodiment in accordance with FIG. 4 for components, which correspond to the components of the previously described embodiments, similar reference numerals are used, however they are preceded by a "3". The high-pressure pump 310 is embodied as a radial piston pump with, for example 3 to 5 radial pistons 352, which are controlled via an eccentric shaft 353. Fuel is supplied to the high-pressure pump 310 by means of the pre-conveying pump 314, namely via a nonreturn valve 354, prestressed by a spring, to a displacement chamber 355. The nonreturn valve 354, i.e. more precisely the valve body of the nonreturn valve 354, can be triggered by means of a needle element 356 of an adjusting piston 357 and can be maintained in the open position, because of which the compression piston 352 is quasi switched off. The adjusting piston 357 is prestressed by means of a spring 358 in a direction in which the needle element 356 is retracted and the nonreturn valve 354 remains functional. A signal pressure chamber 359, which is connected to the signal pressure line 326, is formed on the other side of the spring 358. In conformance with the previously described embodiments, the signal pressure line 326 branches off the delivery line 328B upstream of a dynamic throttle 332, i.e. between the dynamic throttle 332 and the electrically adjustable pressure control valve 330. Therefore if the pressure in the high-pressure line 312 becomes too high, an appropriate amount of fuel is sprayed off via the pressure control valve 330, a signal pressure is built up in the signal line 326 which, by displacing the piston 357 and the needle element 356 keeps the valve 354 in the open position, so that the displacement piston 352 is switched off. A separate adjusting element 356, 357 is associated with each individual displacement piston 352 in the embodiment in accordance with FIG. 4, so that the displacement pistons 352 can be individually switched in or out. In this case the switch-out can also take place staggered, i.e. sequentially. But the idea of the invention is not abandoned if the individual adjusting elements are synchronously actuated, so that the displacement pistons can be simultaneously switched in or out.

Figure 5:
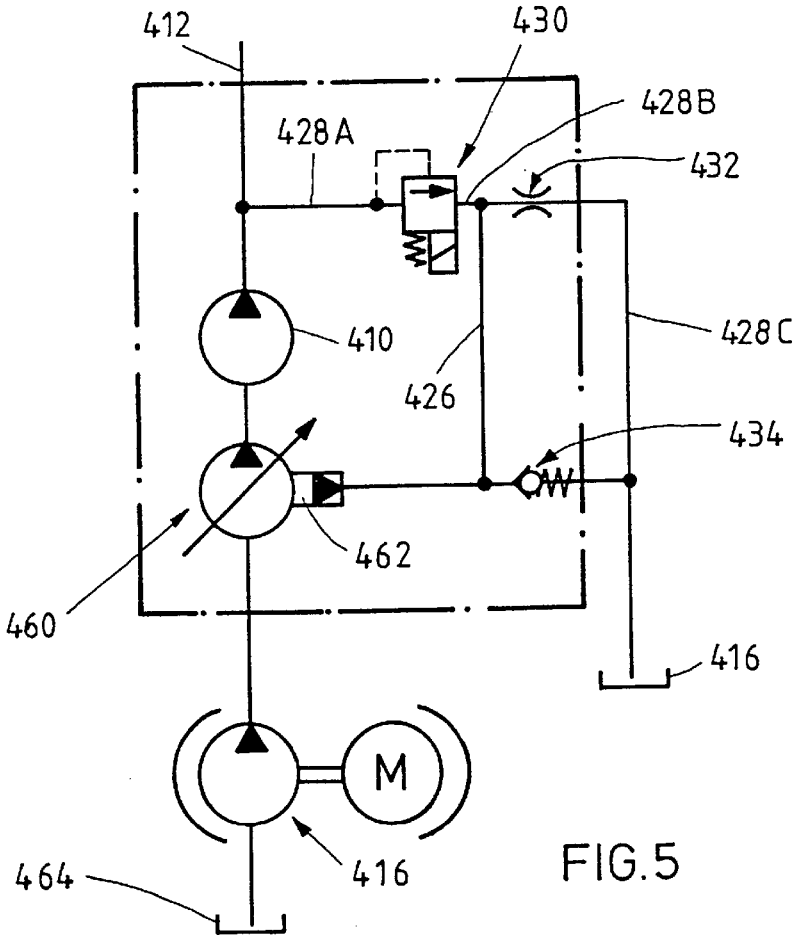
FIG. 5, a further variant of adjustment signal processing corresponding to FIG. 1.

The control is represented in a modification in the embodiment in accordance with FIG. 5, wherein the adjusting signal is employed in a changed way for limiting the amount of fluid conveyed. This embodiment corresponds to a large extent to that in accordance with FIG. 1, so that a detailed description of the corresponding components can be omitted here. Reference numerals which are preceded by a "4" are used for comparable components.

In this exemplary embodiment the adjusting signal in the line 426 is supplied to an adjusting element 462 of an adjustable pre-conveying pump 460, which can be adjusted, for example, within a range of 5 bar. This adjustable pre-conveying pump can be supplied by an upstream-connected additional low-pressure pump 464. Otherwise the mode of operation is comparable to that in the embodiment in accordance with FIG. 1.

Figure 6:
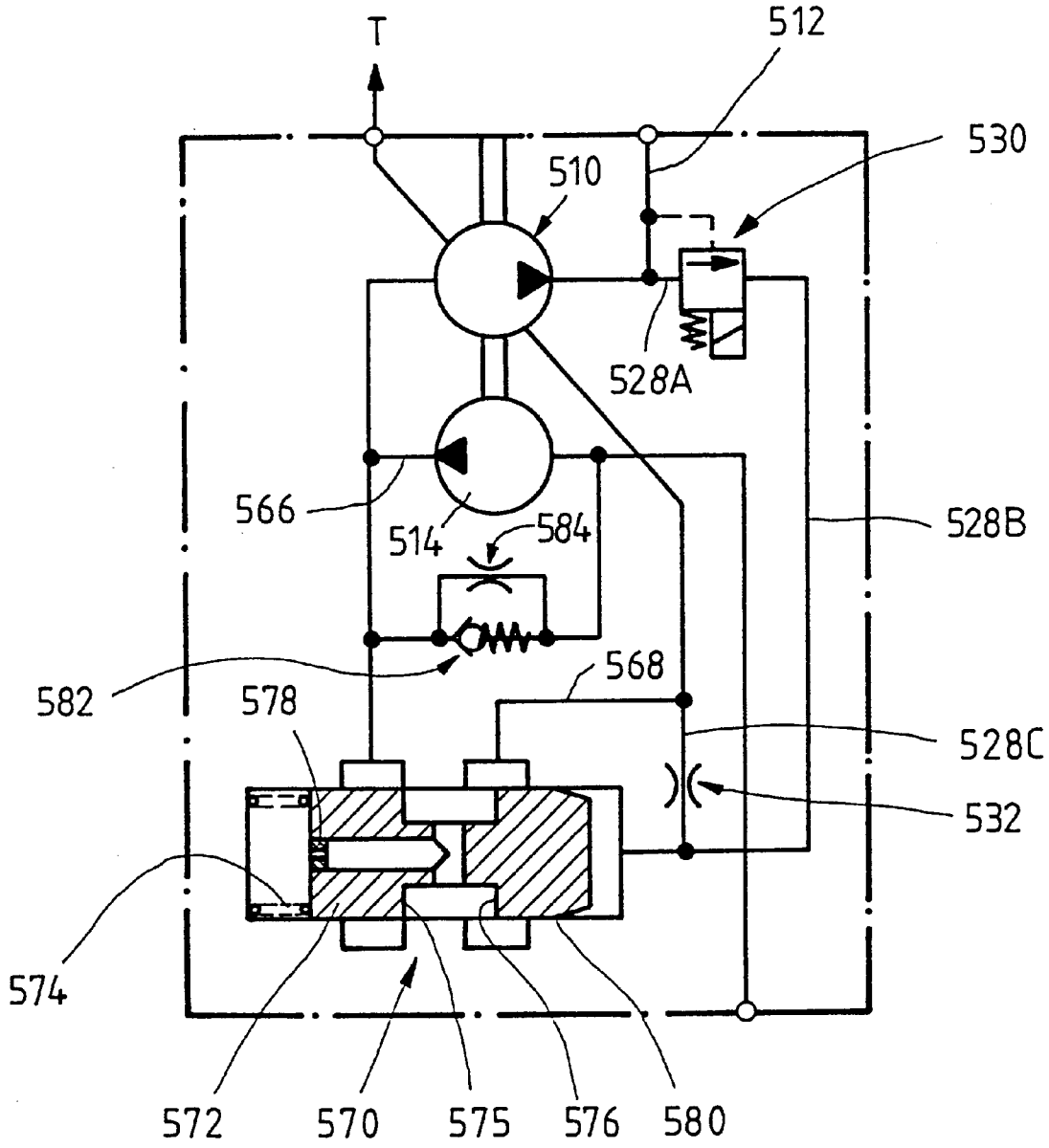
FIG. 6, in a representation corresponding to FIGS. 1 and 5, a further variant of the control circuit for the high pressure in the common rail with a changed embodiment for obtaining the adjusting signal for affecting the amount of fluid conveyed.

Finally, a still further embodiment of the control is described by means of FIG. 6, which is distinguished by an especially simple integration of a safety valve into the device for limiting the amount of fluid conveyed. In this embodiment, too, similar reference numerals, which are preceded by a "5", are used for the components which correspond to the elements of the previously described exemplary embodiments.

Here, too, a high-pressure pump 510 is supplied by a pre-conveying pump 514. A preferably proportionally adjustable pressure control valve 530 is connected to the high-pressure line 512. The pressure control valve 530 is located in the delivery line 528, in which a dynamic throttle 532 has also been installed. Here, too, the pressure in the line section 528 is utilized as the adjusting signal pressure for changing the amount of fluid conveyed, namely in the following manner:

The pressure at the inlet of the high-pressure pump 510 acts by means of a change of the flow cross section between a pressure outlet 566 of the pre-conveying pump 514 and a tank line 568. An adjustable delivery orifice 570 has been inserted for this purpose between the pressure outlet 566 and the tank line 568, which has a control piston 572 which, in the closing direction, is acted on by the force of a spring 574, and in the opening direction by the dynamic or by the signal pressure in the line 528B. The throttle control edges of the adjustable delivery orifice 570 are identified by 575 and 576. The spring chamber is pressure-relieved via a nozzle 578.

An additional control edge is identified by the reference numeral 580, through which the pressure in the signal pressure line 528B can be relieved by opening a connection to the tank line 568, because of which the adjustable delivery orifice 570 constitutes a safety and rapid delivery valve.

In further deviation from the previously described exemplary embodiments, a safety valve 582 in the form of a nonreturn valve with a spring-loaded closing body, with which a orifice 584 is switched in parallel, is located in the bypass to the pre-conveying pump 514. By means of the plate 584 an adaptation of the control characteristics to the rpm of the pre-conveying pump and thus of the internal combustion engine results. This has an effect in that a finer pressure control can be achieved than would be the case with a dynamic pressure-controlled delivery orifice 570 alone.

Deviations from the above described exemplary embodiments are of course possible without departing from the basic concept of the invention. For example, differing from the embodiments of FIGS. 1 to 3, it is possible to operate with an arrangement wherein a separate directional control valve is assigned to each displacement piston in place of a central suction throttle valve 22, 122 or 222, wherein the valve slide of this directional control valve is then displaced infinitely variably as a function of the dynamic pressure in such a way, that the individual displacement devices are throttled by means of the dynamic pressure and the appropriate valve slides. In this case the displacement devices can be simultaneously throttled. However, in the same way a sequential throttling can take place one after the other in that, for example, the restoring spring forces at the individual slide elements are laid out differently.

Thus the invention provides a control for a pressure fluid supply system, in particular for the high pressure in a fuel injection system, for example for an internal combustion Diesel engine, by means of which the pressure in a common high-pressure line supplied by a high-pressure pump, i.e. in the common rail, to which individual consumers are connected, is controlled in accordance with the instantaneous pressure fluid requirements. For adapting the pressure in the common high-pressure line to the pressure fluid requirements of the consumers, i.e. the injection nozzles, a device for limiting the amounts of fluids conveyed is associated with the high-pressure pump, which has at least on adjusting member which can be changed by means of an adjusting signal representing the instantaneous pressure fluid supply situation in the common rail. To avoid an elaborate pressure sensor device in the common rail and for the simultaneous improvement of the reaction behavior of the control, in particular when reducing the high pressure in the common rail, the adjusting signal is derived from the amount of fluid throughput in the delivery line of a pressure control valve connected to the common rail. The pre-conveying pressure or the pre-conveying amount available to the high-pressure pump is affected by means of this adjusting signal in the sense of a regulation of the pressure in the common rail.

What is claimed is:

1. A method of controlling a pressure fluid supply system, the method which comprises:

generating, with a high-pressure pump, a pressure in a common high-pressure line;

providing a delivery line connected to the common high-pressure line;

providing an adjustable pressure control valve in the delivery line for controlling a fluid throughput in the delivery line;

determining a motion value of the adjustable pressure control valve in accordance with the fluid throughput in the delivery line;

providing, upstream of the high pressure pump, a fluid conveyance limiting device for adjusting the pressure in the common high-pressure line in accordance with a pressure fluid requirement of consumers connected to the high-pressure line;

providing an actuating element for controlling the fluid conveyance limiting device;

deriving, from the motion value of the adjustable pressure control valve, an adjusting signal representing a current pressure fluid supply situation in the common high-pressure line; and controlling the actuating element with the adjusting signal.

2. A method of controlling a pressure fluid supply system, the method which comprises:

generating, with a radial jet pump, a pressure in a common high-pressure line;

providing a delivery line connected to the common high-pressure line;

providing an adjustable pressure control valve in the delivery line for controlling a fluid throughput in the delivery line;

determining, downstream of the adjustable pressure control valve, a physical quantity changing in accordance with the fluid throughput in the delivery line;

providing, upstream of the radial jet pump, a fluid conveyance limiting device for adjusting the pressure in the common high-pressure line in accordance with a pressure fluid requirement of consumers connected to the high-pressure line;

providing an actuating element for controlling the fluid conveyance limiting device;

deriving, from the physical quantity, an adjusting signal representing a current pressure fluid supply situation in the common high-pressure line; and controlling the actuating element with the adjusting signal.

3. The method according to claim 2, which comprises deriving the adjusting signal from a dynamic pressure upstream of a dynamic throttle in the delivery line.

4. The method according to claim 2, which comprises deriving the adjusting signal from a temperature in the delivery line.

5. The method according to claim 1, which comprises providing, as the fluid conveyance limiting device, a suction throttle device connected upstream of the high pressure pump.

6. The method according to claim 5, which comprises providing the suction throttle device with a given number of suction valves, the given number corresponding to a number of displacement devices of the high-pressure pump and the given number of suction valves being provided in respective inlet lines of the displacement devices.

7. The method according to claim 6, which comprises sequentially driving the given number of suction valves.

8. The method according to claim 5, which comprises:

providing the suction throttle device with at least one suction throttle valve having a valve body; and displacing, with the adjusting signal, the valve body against a restoring force.

9. The method according to claim 8, which comprises providing the at least one suction throttle valve as a continuously adjustable directional control valve.

10. The method according to claim 1, which comprises:

providing the fluid conveyance limiting device with at least one adjusting element; and adjusting a compression output of the high-pressure pump with the at least one adjusting element.

11. The method according to claim 1, which comprises providing the fluid conveyance limiting device with adjusting elements;

assigning the adjusting elements to respective displacement devices of the high-pressure pump; and adjusting a compression output of the high-pressure pump with the adjusting elements.

12. The method according to claim 11, which comprises responding, with the adjusting elements, sequentially to the adjusting signal.

13. The method according to claim 10, which comprises:

providing the at least one adjusting element with a piston body; and displacing, with the adjusting signal, the piston body against a restoring force.

14. The method according to claim 13, which comprises acting, with the at least one adjusting element, on a closing body of a nonreturn valve of a displacement chamber of the high-pressure pump.

15. The method according to claim 1, which comprises providing the fluid conveyance limiting device as an adjustable pre-conveying pump.

16. The method according to claim 15, which comprises changing, with the adjusting signal, a stroke volume.

17. The method according to claim 1, which comprises providing the fluid conveyance limiting device as an adjustable delivery plate in a branch line leading from a pressure outlet of a pre-conveying pump to a low-pressure region.

18. The method according to claim 17, which comprises:

providing the delivery plate with a control piston;

applying, with a compression spring, a force in a closing direction of the control piston; and applying a force in accordance with the adjusting signal in an opening direction of the control piston.

19. The method according to claim 18, which comprises:

providing the control piston with a control edge; and rapidly and substantially with out a throttling, relieving, with the control edge, a pressure in the delivery line into a low pressure region.

20. The method according to claim 17, which comprises:

providing a pressure protection valve in a bypass to the pre-conveying pump; and providing a plate connected in parallel to the pressure protection valve.

21. The method according to claim 10, which comprises providing the pressure protection valve as a prestressed nonreturn valve.

22. The method according to claim 3, which comprises limiting a pressure in the delivery line with a safety valve.

23. The method according to claim 22, which comprises:

providing the safety valve as a prestressed nonreturn valve for a rapid pressure relief in the common high-pressure line by draining an increased amount of fluid.

24. The method according to claim 3, which comprises providing the adjusting signal as a signal corresponding to a dynamic pressure.

25. The method according to claim 3, which comprises obtaining the adjusting signal with a low-pressure sensor in the delivery line.

26. The method according to claim 4, which comprises:

integrating, in the delivery line, a thermal sensor having an expandable element; and obtaining the adjusting signal with the thermal sensor.

27. The method according to claim 1, which comprises providing the adjustable pressure control valve as a proportional control valve.

28. The method according to claim 5, which comprises providing the suction throttle device as a single suction throttle located in an inlet line of the high-pressure pump.

* * * * *